US008561927B2

(12) United States Patent
Ko

(10) Patent No.: US 8,561,927 B2
(45) Date of Patent: Oct. 22, 2013

(54) PNEUMATIC CONTINUOUS IMPACT PULVERIZER

(75) Inventor: Chih-Lien Ko, Taichung (TW)

(73) Assignee: Diamond Polymer Science Co., Ltd., Taichung (TW)

( * ) Notice: Subject to any disclaimer, the term of this patent is extended or adjusted under 35 U.S.C. 154(b) by 332 days.

(21) Appl. No.: 13/168,295

(22) Filed: Jun. 24, 2011

(65) Prior Publication Data

US 2012/0325945 A1 Dec. 27, 2012

(51) Int. Cl.
*B02B 1/00* (2006.01)

(52) U.S. Cl.
USPC ..... 241/39; 241/1; 241/5; 241/284

(58) Field of Classification Search
USPC ..... 241/1, 5, 15, 16, 19, 21, 23, 34, 38, 39, 241/40, 60, 79, 284
See application file for complete search history.

(56) References Cited

U.S. PATENT DOCUMENTS 8,387,901 B2 * 3/2013 Flynn et al. ..... 239/592

* cited by examiner

*Primary Examiner* — Dana Ross
*Assistant Examiner* — Homer Boyer
(74) *Attorney, Agent, or Firm* — Muncy, Geissler, Olds & Lowe, PLLC

(57) ABSTRACT

A pneumatic continuous impact pulverizer includes an outer tube, an inner tube located in the outer tube, an air intake material feeding port located at a front end of the outer tube, an air pump located at the air intake material feeding port, and a plurality of impact tubes. The impact tubes respectively run through the tubular wall of the inner tube, and each has an airflow passage which includes a bell-shaped opening communicating with the outer tube, a middle branch opening located at one side of the airflow passage close to the air intake material feeding port and communicating with the inner tube, and an outlet communicating with the inner tube. High pressure gas and powders enter through the air intake material feeding port. The high pressure gas carries the powders to pass through the impact tubes where the powders collide with each other to become nano powders.

6 Claims, 4 Drawing Sheets

PNEUMATIC CONTINUOUS IMPACT PULVERIZER

FIELD OF THE INVENTION

The present invention relates to a nano technology and particularly to a dry nano technology.

BACKGROUND OF THE INVENTION

Materials can present different characteristics after being formed in nano scales and can be used in varying applications. Thus the nano materials attract a lot of attention in many industries. Conventional techniques of fabricating the nano materials mainly can be divided into wet approach and dry approach. The wet approach mainly generates nano powders through separation of chemical ions. Such an approach has a drawback of clusters of nano powders after a drying process.

The dry approach mainly generates nano powders through mechanical grinding. It also has drawbacks of energy consumption, small production, great differences in particle sizes, discontinuous production, and high maintenance cost.

Due to the high production cost and great energy consumption, the conventional dry approach of producing nano powders cannot meet the prevailing requirements of energy saving and carbon reduction.

SUMMARY OF THE INVENTION

Therefore, the primary object of the present invention is to provide a nano powder fabrication apparatus that is lower cost, less energy consumption and simpler in maintenance to meet use requirements.

The present invention provides a pneumatic continuous impact pulverizer that includes an outer tube, an inner tube, a dust collection port, an air intake material feeding port, an air pump and a plurality of impact tubes. The inner tube is located in the outer tube. The dust collection port is located at a distal end of the inner tube. The air intake material feeding port is located at a front end of the outer tube. The air pump is located at the air intake material feeding port. The impact tubes are respectively formed in a tilt manner and run through the tubular wall of the inner tube. Each impact tube has an airflow passage which includes a bell-shaped opening, a middle branch opening and an outlet. The bell-shaped opening communicates with the outer tube. The middle branch opening is located at one side of the airflow passage close to the air intake material feeding port and communicates with the inner tube. The outlet communicates with the inner tube.

Because of the impact tubes, airflow is converged at the middle branch opening and outlet so that powders carried by the airflow collide with one another and are divided into smaller particles. After passing through a plurality of impact tubes, the powers are divided into nano scales. The air pump is the only power source required. Mechanical elements are almost not worn. Thus the cost is lower, energy consumption is less and maintenance is easier to meet use requirements.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
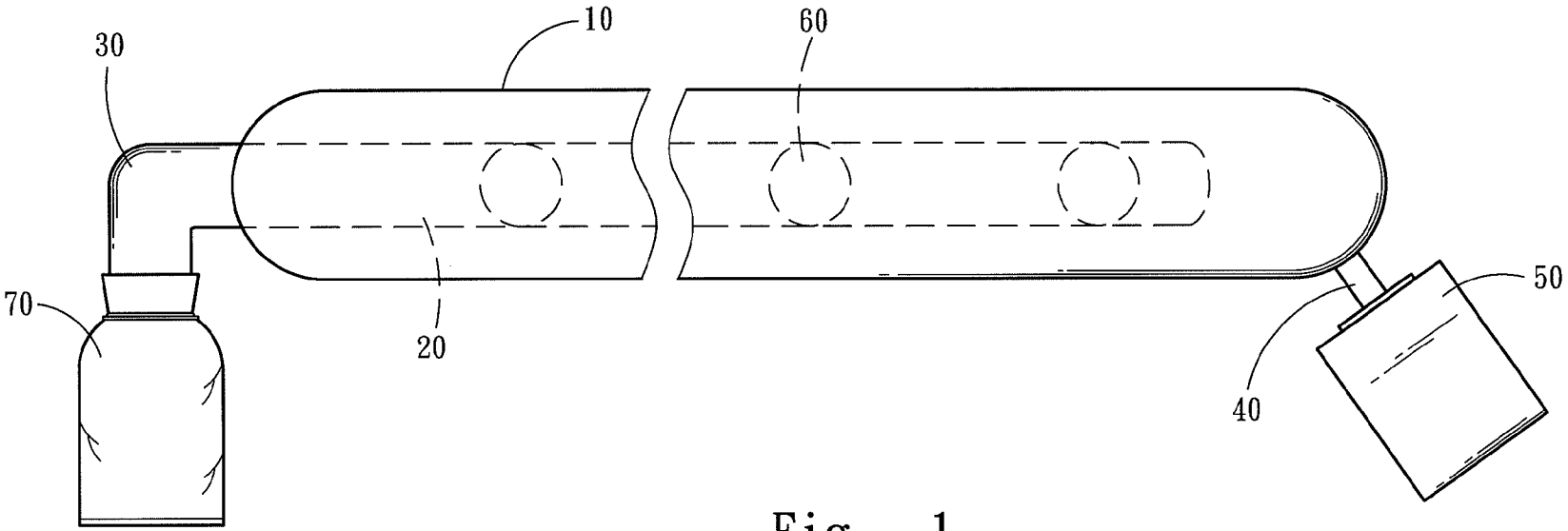
FIG. 1 is a perspective view of the invention.
Figure 2:
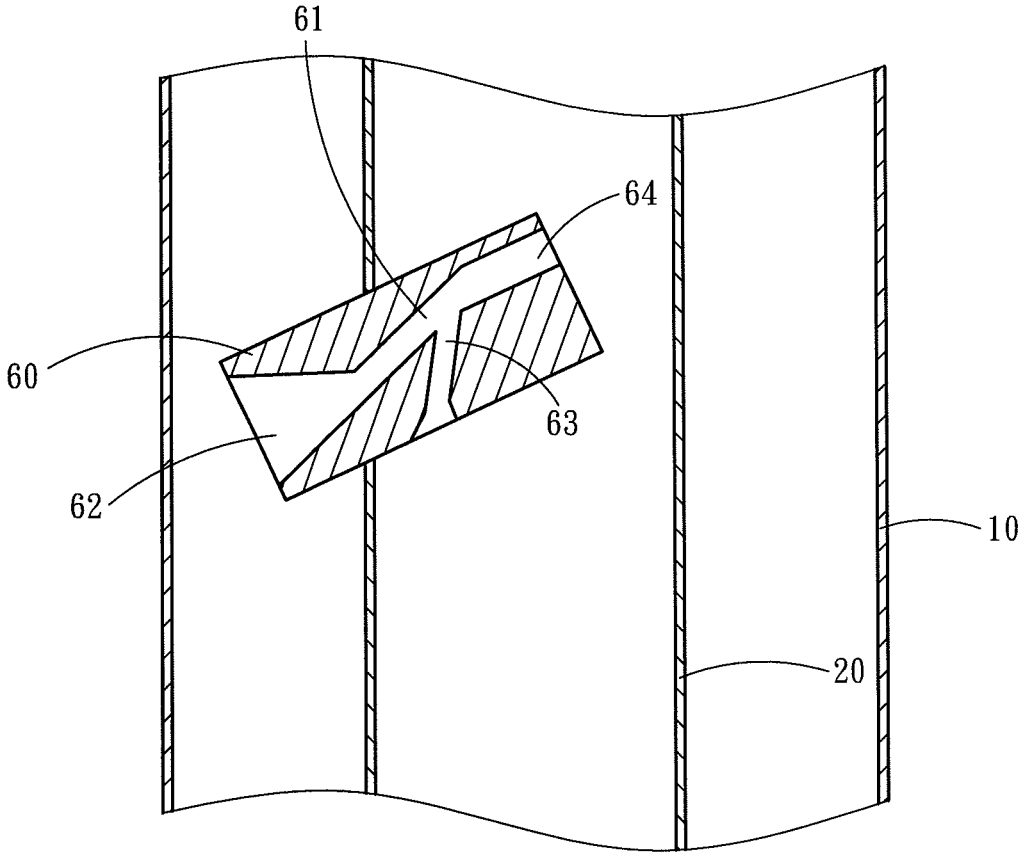
FIG. 2 is a sectional view of an impact tube of the invention.
Figure 3:
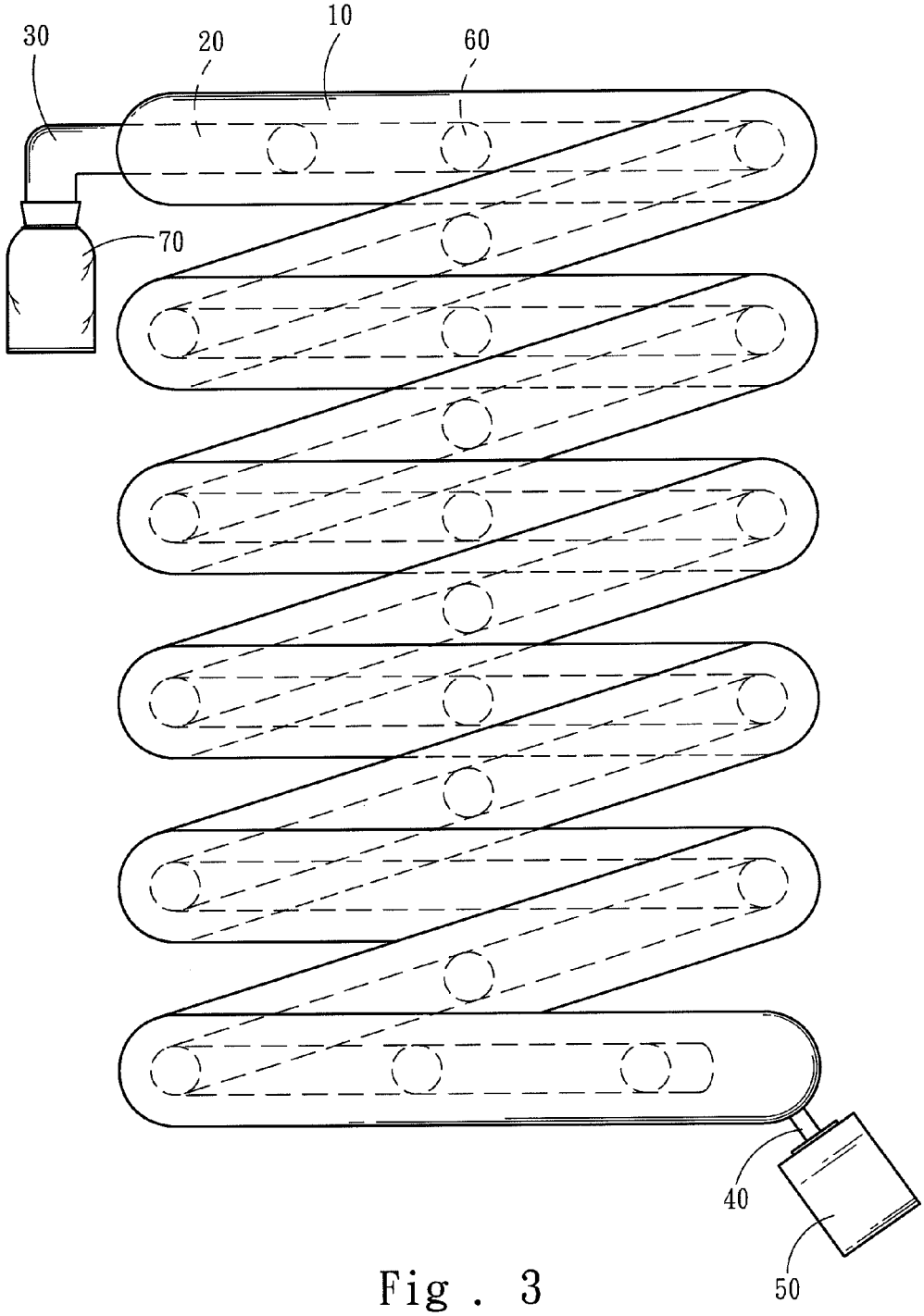
FIG. 3 is a perspective view of an embodiment of the invention.

Please refer to FIGS. 1, 2 and 3, the present invention provides a pneumatic continuous impact pulverizer that includes an outer tube 10, an inner tube 20, a dust collection port 30, an air intake material feeding port 40, an air pump 50 and a plurality of impact tubes 60. The inner tube 20 is located in the outer tube 10. The lengths of the inner tube 20 and outer tube 10 can be adjusted as required without restrictions. The outer tube 10 and inner tube 20 can also be formed helically in continuous S shapes to save space.

The dust collection port 30 is located at a distal end of the inner tube 20 and is fastened to a dust collection pouch 70. The air intake material feeding port 40 is located at a front end of the outer tube 10. The air pump 50 is located at the air intake material feeding port 40 to output high pressure gas 90 to carry powders 80 to enter the outer tube 10 via the air intake material feeding port 40 (also referring to FIG. 4).

The impact tubes 60 are respectively formed in a tilt manner and run through the tubular wall of the inner tube 20. Each impact tube 60 has an airflow passage 61 which includes a bell-shaped opening 62, a middle branch opening 63 and an outlet 64. The bell-shaped opening 62 communicates with the outer tube 10. The middle branch opening 63 is located at one side of the airflow passage 61 close to the air intake material feeding port 40 and communicates with the inner tube 20. The outlet 64 communicates with the inner tube 20.

Figure 4:
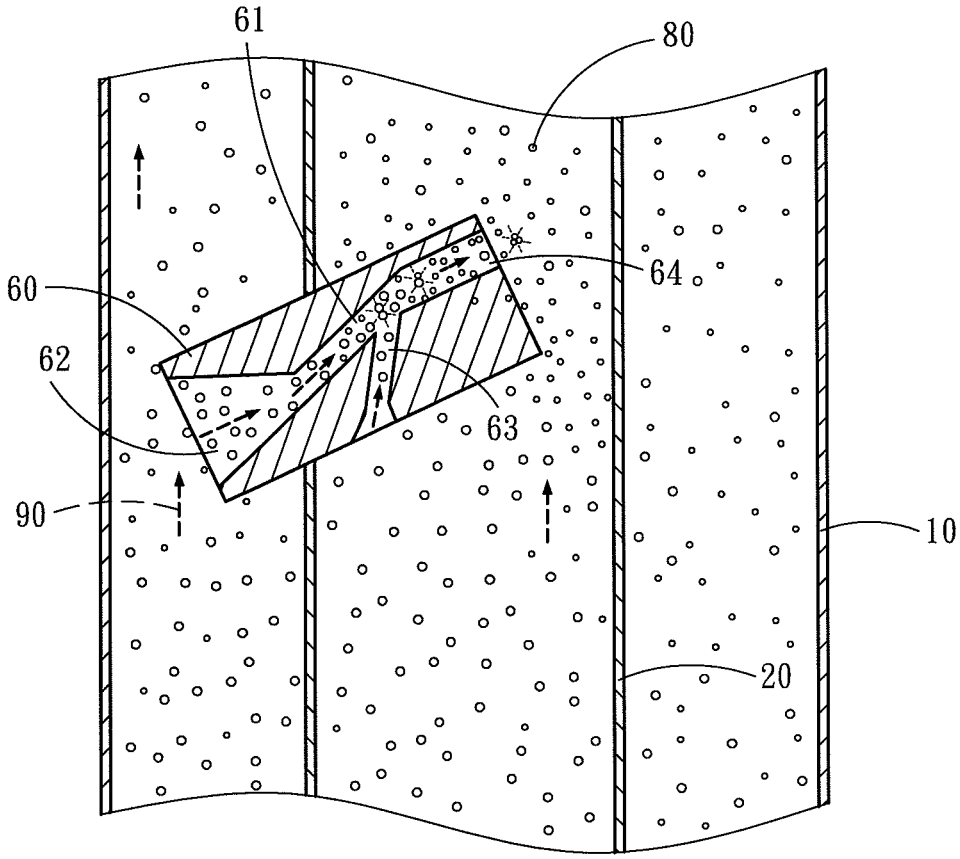
FIG. 4 is a schematic view of the invention showing collision of particles in the connected passages.

Referring to FIG. 4, the powders 80 are moved rapidly by pushing of the high pressure gas 90 in the outer tube 10, and enter the inner tube 20 after passing through the impact tubes 60 through flow division. While the powders 80 are moved rapidly in the outer tube 10, inner tube 20 and impact tubes 60, airflow is converged at the middle branch opening 63 and outlet 64, hence the powders 80 which are moved rapidly collide with one another and are separated to become nano powders 80 after a number of collisions. Finally the nano powders 80 are collected by the dust collection pouch 70 at the dust collection port 30 to finish operation of fabricating nano powders 80.

In order to optimize the collision, the outer tube 10 can be formed at a diameter of 100 μm, the inner tube 20 can be formed at a diameter of 50 μm, and the bell-shaped opening 62 can be formed with an outlet and an inlet at a ratio of 30:8. For instance, if the outlet of the bell-shaped opening 62 is formed at a diameter of 30 μm, the inlet thereof is formed at a diameter of 8 μm. Moreover, the middle branch opening 63 can be formed at a diameter of 7 μm, and the outlet 64 can be formed at a diameter of 10 μm. The impact tubes 60 are spaced from each other at a distance from 300 μm to 500 μm.

In short, the invention employs high pressure gas 90 to carry the powders 80 to collide with each other, so that the size of the powders 80 can be effectively reduced. After a number of collisions take place, the powders 80 can be formed in nano scales. The equipment of the invention is simple and can be made at a lower cost. Energy consumption also is lower and mechanical elements are almost not worn, thus can meet requirements of lower cost, less energy consumption and easier maintenance.

What is claimed is:

1. A pneumatic continuous impact pulverizer, comprising: an outer tube;

an inner tune located in the outer tube;

a dust collection port located at a distal end of the inner tube;

an air intake material feeding port located at a front end of the outer tube;

an air pump located at the air intake material feeding port; and a plurality of impact tubes respectively formed in a tilt manner and running through the tubular wall of the inner tube, each impact tube including an airflow passage which includes a bell-shaped opening, a middle branch opening and an outlet; the bell-shaped opening communicating with the outer tube, the middle branch opening being located at one side of the airflow passage close to the air intake material feeding port, the outlet communicating with the inner tube.

2. The pneumatic continuous impact pulverizer of claim 1, wherein the outer tube and the inner tube are formed helically in continuous S shapes.

3. The pneumatic continuous impact pulverizer of claim 1, wherein the bell-shaped opening is formed with an outlet and an inlet at a ratio of 30:8.

4. The pneumatic continuous impact pulverizer of claim 3, wherein the outer tube is formed at a diameter of 100 μm, the inner tube being formed at a diameter of 50 μm, the outlet of the bell-shaped opening being formed at a diameter of 30 μm and the inlet thereof being formed at a diameter of 8 μm, the middle branch opening being formed at a diameter of 7 μm, the outlet of the airflow passage of the impact tube being formed at a diameter of 10 μm.

5. The pneumatic continuous impact pulverizer of claim 4, wherein the impact tubes are spaced from each other at a distance from 300 μm to 500 μm.

6. The pneumatic continuous impact pulverizer of claim 1, wherein the dust collection port is fastened to a dust collection pouch.

* * * * *